United States Patent [19]

Lieber

[11] 4,248,126

[45] Feb. 3, 1981

[54] ADJUSTABLE BRIDGE

[76] Inventor: Thomas G. Lieber, 9 E. Valley Stream Blvd., Valley Stream, N.Y. 11580

[21] Appl. No.: 114,225

[22] Filed: Jan. 22, 1980

[51] Int. Cl.[3] ..... G10D 3/04

[52] U.S. Cl. ..... 84/299; 84/307

[58] Field of Search ..... 84/298, 299, 307

[56] References Cited

U.S. PATENT DOCUMENTS

| | | | |
|---|---|---|---|
| 2,918,837 | 12/1959 | Webster | 84/312 |
| 2,972,923 | 2/1961 | Fender | 84/307 X |
| 3,237,502 | 3/1966 | Moseley | 84/307 X |
| 3,429,214 | 2/1969 | Jones | 84/314 N |
| 4,135,426 | 1/1979 | Rickard | 84/307 X |
| 4,160,401 | 7/1979 | Tomioka | 84/307 X |

*Primary Examiner*—Lawrence R. Franklin

*Attorney, Agent, or Firm*—J. Michael Rosso

[57] ABSTRACT

A panel having a rear wall is movably secured to the lower portion of a guitar body by a pair of screws allowing it to be moved toward and away from the guitar body. A sliding member is disposed in the panel under each guitar string, with a string contacting member secured on top of each slidable member and itself being slidable laterally thereon. Accordingly, guitar strings can be adjusted up and down the guitar, toward and away from the body, and across the fretboard, to thereby achieve optimum intonation and playability.

7 Claims, 4 Drawing Figures

FIG. 1
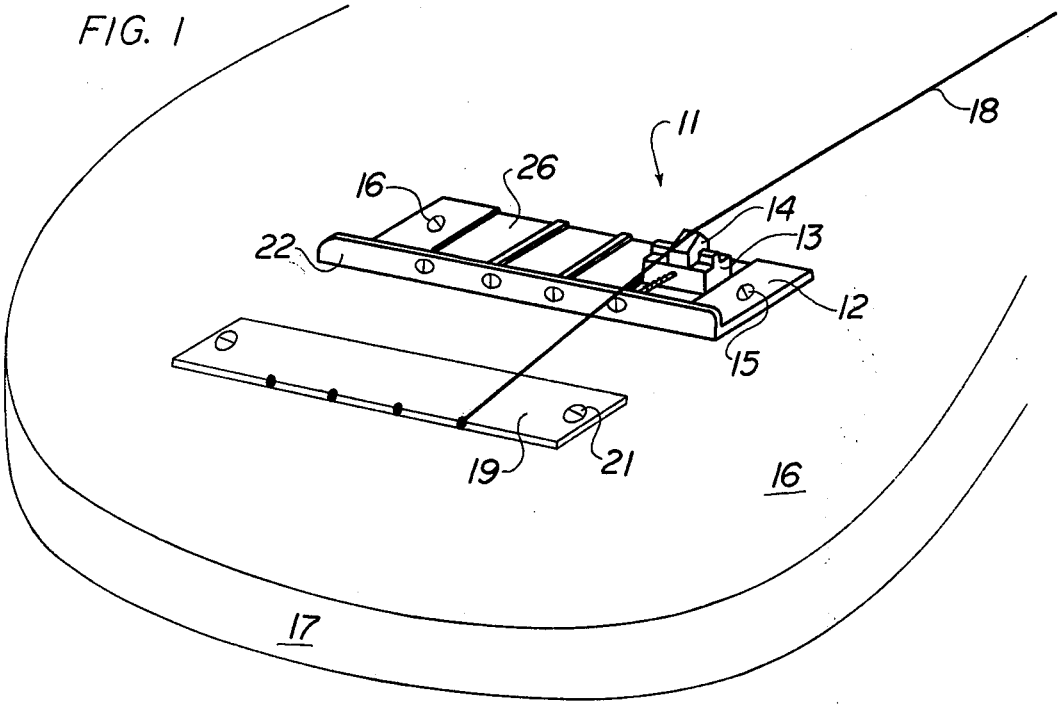
FIG. 2
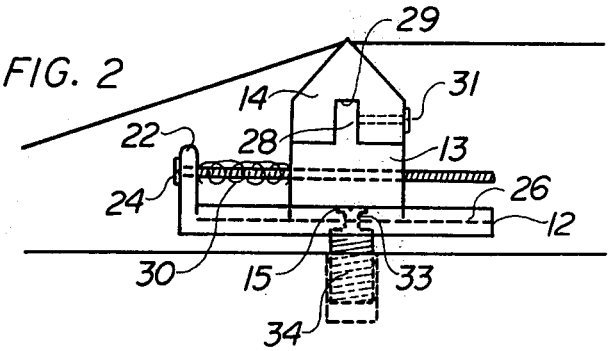
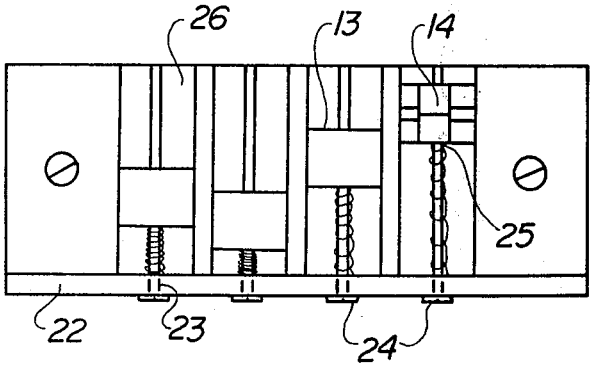
FIG. 3
FIG. 4
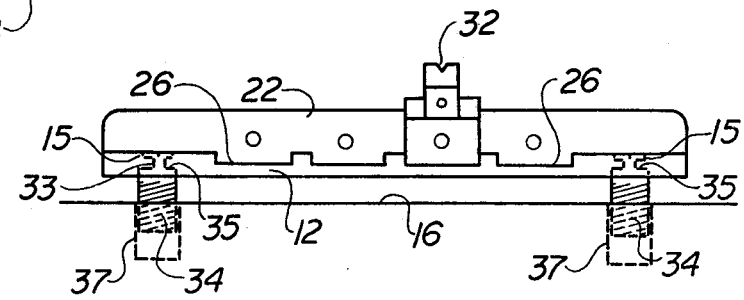

ADJUSTABLE BRIDGE

BACKGROUND OF THE INVENTION

This invention relates to guitars, and, more particularly, to an improved adjustable bridge for guitars.

Guitar bridges are important in assuring proper intonation of the guitar strings, as well as for eliminating string buzzing and improving playability. Proper intonation is possible only when the distance from the nut to the bridge remains constant. Buzzing and playability are determined by the distance of the strings from the fretboard, and the spacing apart of the strings across the fretboard. Only when all of these distances are accurately fixed can the guitar produce its optimum sound.

Adjustable bridges are available for increasing or decreasing the distance from the nut to the bridge, for intonation purposes. Also, such bridges can be adjusted for raising or lowering the strings above the fretboard. However, there is not available an adjustable bridge for easily and accurately adjusting the strings in all three directions, namely, up and down the fretboard, toward and away from the fretboard, and across the fretboard.

SUMMARY OF THE INVENTION

In accordance with this invention there is provided an improved adjustable bridge comprising a panel positioned under the guitar strings, means for securing the panel to the guitar body such that it can be raised or lowered above the guitar body, sliding members adapted for sliding movement on the panel under and along each string, a string contacting member connected above each sliding member, and means for arresting movement of the string contacting member on each sliding member.

Preferably, the panel is secured to the guitar body by a pair of screws inset into the panel on either side thereof, the screws extending into threaded metal inserts set into the guitar body. The lower portions of the screws have enlarged diameters. Turning of the screws will raise or lower the panel, and hence the guitar strings. Also, the panel is preferably formed with a rear wall having apertures aligned with the strings, and the sliding members have threaded apertures for receiving screws inserted through the rear wall apertures, to allow individual sliding of the members by turning of the screws.

It is a primary object of this invention to provide an adjustable guitar bridge for allowing the guitar strings to be adjusted up and down the guitar, toward and away from the fretboard, and across the fretboard.

It is another object of this invention to provide a three-way adjustable bridge that can be inexpensively manufactured and easily installed on either an acoustic or electric guitar body.

It is a further object of this invention to provide an adjustable guitar bridge that can be readily adjusted to accurately set individual guitar strings for optimum intonation.

BRIEF DESCRIPTION OF THE DRAWINGS

FIG. 1 is a partial perspective view showing the adjustable bridge of this invention in position on a guitar body.

FIG. 2 is a side view of the adjustable bridge shown in FIG. 1.

FIG. 3 is a top view of the adjustable bridge shown in FIG. 1.

FIG. 4 is a front elevational view of the adjustable bridge shown in FIG. 2.

DESCRIPTION OF THE PREFERRED EMBODIMENTS

Referring to FIG. 1 of the drawings, adjustable bridge 11, formed of panel 12, with sliding members 13 and string contacting members 14, is secured by screws 15 to guitar body 16 above its lower bout 17. Guitar strings 18 pass over string contacting members 14 and are secured to body 16 by means of plate 19 and screws 21. It is seen that adjustable bridge 11 occupies a minimum of space on the guitar, and does not detract from the aesthetic look of the instrument. Adjustable bridge 11 can be advantageously used on both acoustic and electric guitars, although its use on electric guitars has proven to be especially valuable.

Referring to FIGS. 2, 3, adjustable bridge 11 has a short rear wall 22 extending across the length of panel 12. Apertures 23 are formed in rear wall 22 in line with guitar strings 18, and screws 24 are inserted through the apertures and into threaded apertures 25 of each sliding member 13. Screws 24 are individually turned in either a clockwise or counter-clockwise direction to bring about sliding movement of sliding members 13 up and down tracks 26 of panel 12. Such action serves to move the point of contact of each string 18 with its corresponding string contacting member 14 either up or down the guitar, thereby decreasing or increasing the effective playing length of each string. Springs 30 are disposed on each screw 24 between wall 22 and sliding member 13 for holding sliding members 13 firmly in position. It is thus possible to adjust each string for maximum intonation.

String contacting members 14 are slidably mounted in projections 28 of slidable members 13, the string contacting members having slots 29 for such purpose, as shown in FIG. 2. A set screw 31 extends through the lower portion of each string contacting member 14 and abuts projection 28 of each sliding member 13, to allow firm setting of the components at any desired contact point. Also, the upper edge of each string contacting member 14 has a groove 32 in which the guitar string rides during adjustment.

As shown most clearly in FIG. 4, panel 12 has tracks 26 integrally formed with the panel, which can be constructed of plastic, wood or metal. Tracks 26 consist of slight indentations in the upper surface of panel 12, and extend parallely from rear wall 22 to the upper end of the panel.

Referring to FIGS. 2, 4, screws 15 are inset into the upper surface of panel 12 on either side thereof. The upper portion 33 of each screw is substantially lesser in diameter than lower portion 34, thereby providing a ledge 35 for supporting panel 12 during the raising and lowering operations. Portion 34 of each screw 15 is threaded for reception by threaded metal insert 37, permanently inset into guitar body 16. Turning of screws 15 will effect raising or lowering of panel 12, with consequent raising or lowering of the strings over the fretboard.

Installation of the adjustable bridge of this invention can be simply and inexpensively accomplished. It is only necessary to embed metal inserts 37 within guitar body 16 on either side of the path of guitar strings 18. Panel 12 is positioned across such path and screws 15 inserted and tightened. Guitar strings are then strung onto the guitar over the string contacting members 14, as shown above, and the guitar is ready for tuning.

In operation of the adjustable bridge of this invention, screws 15 are turned one way or the other until the strings are at an accurate height above the fretboard. If the distance is too little, buzzing will occur; if too great, the guitar will be difficult to play. Such adjustment can be quickly accomplished by the guitar player using only a screw driver.

Similarly, screws 24 can be turned either direction to individually shorten or lengthen the effective length of each string. Again, no special tools are required.

Finally, each set screw 31 is manually loosened and the corresponding string contacting member 14 slid in either direction, for accurate spacing apart of the strings. The set screws are then tightened to lock each string into its most accurate setting. The guitar is now ready to be played at its optimum musical level.

It is claimed:

1. An adjustable bridge for guitars comprising:

(a) a panel extending under the guitar strings adjacent the lower ends thereof and being substantially parallel to the upper surface of the guitar body, (b) means for securing the panel to the guitar body and allowing the panel to be manually raised or lowered above the guitar body, (c) a sliding member disposed on the panel beneath each guitar string, with each sliding member being adapted for individual sliding movement on the panel under and along a string, (d) a string contacting member connected above each sliding member and being adapted for movement laterally across each sliding member, such that strings can be moved individually in either direction across the guitar fretboard, with the sliding members allowing adjustment of the point of contact between the string contacting member and an individual string, and (e) means for arresting movement of the string contacting member on each sliding member.

2. The adjustable bridge of claim 1 wherein the means for securing the panel to the guitar body comprises a pair of screws inset into the panel, one on each side thereof, the screws extending into threaded metal inserts set into the guitar body, the lower portions of the screws being substantially greater in diameter than the upper portions thereof.

3. The adjustable bridge of claim 1 wherein the panel additionally comprises a rear wall projecting vertically above the panel but below the upper level of the string contacting members, and screws extending through apertures of the rear wall into threaded apertures located on the sliding members, such that the string contact point for any string can be adjusted by turning of the appropriate screw.

4. The adjustable bridge of claim 1 wherein the upper surface of the panel has tracks running in the direction of the strings, for guiding movement of the sliding members.

5. The adjustable bridge of claim 1 wherein the sliding members have laterally extending projections on their upper surfaces, and wherein each string contacting member has a laterally extending slot, such that the string contacting members can be slid on the projections in either lateral direction.

6. The adjustable bridge of claim 5 wherein the means for arresting movement of each string contacting member comprises a set screw running through the lower portion thereof into contact with the projection of the sliding member.

7. The adjustable bridge of claim 1 wherein the upper surface of each string contacting member has a groove in which the string rides.

* * * * *